US005782075A

United States Patent [19]

Meggle

[11] Patent Number: 5,782,075

[45] Date of Patent: Jul. 21, 1998

[54] APPARATUS FOR WIRE STRANDING AND CONTROL THEREOF

[75] Inventor: Ludwig Meggle, Markt Oberdorf, Germany

[73] Assignee: Maschinenfabrik Niehoff GmbH & Co. KG, Schwabach, Germany

[21] Appl. No.: 722,053

[22] PCT Filed: Apr. 7, 1995

[86] PCT No.: PCT/EP95/01276

§ 371 Date: Oct. 11, 1996

§ 102(e) Date: Oct. 11, 1996

[87] PCT Pub. No.: WO95/27677

PCT Pub. Date: Oct. 19, 1995

[30] Foreign Application Priority Data

Apr. 11, 1994 [DE] Germany ..... 44 12 409.0

[51] Int. Cl.[6] ..... D01H 7/46; D01H 7/92

[52] U.S. Cl. ..... 59/264; 57/93; 57/98; 57/100; 57/66.5; 57/58.52; 57/58.65; 57/58.67; 57/314

[58] Field of Search ..... 57/99, 93, 100, 57/98, 314, 66.5, 58.52, 58.65, 58.67, 58.68

[56] References Cited

U.S. PATENT DOCUMENTS

| | | | |
|---|---|---|---|
| 3,053,039 | 9/1962 | Demmel | 57/58.52 |
| 4,446,688 | 5/1984 | Ueda | 57/58.67 |
| 4,628,676 | 12/1986 | Lepach et al. | 57/58.67 |
| 5,209,414 | 5/1993 | Clemens et al. | 242/25 R |
| 5,557,914 | 9/1996 | Maccaferri | 57/264 |

FOREIGN PATENT DOCUMENTS

| | | |
|---|---|---|
| 3438178 | 4/1986 | Germany . |
| 3500949 | 7/1986 | Germany . |
| 3810532 | 10/1989 | Germany . |

*Primary Examiner*—William Stryjewski
*Attorney, Agent, or Firm*—George W. Rauchfuss, Jr.

[57] ABSTRACT

Apparatus and process for the production of stranded wire from copper wire, whereby the stranded wire is wound upon a spool by means of a transfer mechanism. A control arrangement is provided, which regulates the rotation of the spool, the motion of a transfer element which is a component of a transfer mechanism and a separate drive for the transfer mechanism.

16 Claims, 7 Drawing Sheets

APPARATUS FOR WIRE STRANDING AND CONTROL THEREOF

FIELD OF THE INVENTION

The present invention concerns an apparatus for the production of stranded copper wire and the like. Further the invention is in regard to a procedure for the control of an apparatus for the production of stranded wire and the like.

BACKGROUND OF THE INVENTION

For the manufacture of flexible, electrical conductors, such as find application in all branches of industry, normally copper wires of relatively small diameter are worked into a strand, which is then covered with an electrical insulating material. The production of this stranded wire is done generally in a double stroke stranding machine. The invention will on this account be described in relation to a double stroke stranding machine. However, notice is given that the application of the invention is not limited solely to a double stroke stranding machine, but finds application with other, similarly operating stranding and cable machines. In addition, the invention is also employed to work materials which are not copper into a flexible stranded or similar stranded object.

An apparatus for the production of stranded wire in accord with the generic preamble portion of the independent apparatus claim 1 has been made known by the DE 35 00 949 C2. In the case of this arrangement, which is designed as a double stroke stranding machine, is found a rotor with two yokes, which is so swivelably mounted, that it is able to rotate itself about a horizontal axis. The rotor is driven by a motor. Within the rotor a spool carrier is mounted, on which a spool is turnably set. This spool is put into rotation by a second motor, which is placed outside of the rotor. The turning power of the motor is transmitted to the spool by a gear drive. The finished stranded wire is wound on this spool. For the removal of the spool, a displacement apparatus is employed, which possesses a threaded spindle, which is installed parallel to the rotating axis of the spool. A transfer mechanism, normally a transfer element directs the finished stranded wire on to the spool and as it does so, runs back and forth parallel to the spool axis so that the stranded wire is wound evenly on the spool. The drive of the transfer apparatus is kinematically coupled firmly with the rotating movement of the spool, so that a given RPM of the spool calls forth a corresponding linear displacement of the transfer element.

From EP 0 563 905 A1, an additional arrangement for the making of stranded wire is made known, wherein inside the rotor, a winding spool is employed, the rotating axis of which is installed transverse to that of the rotor. Even in this case a transfer apparatus is provided which is kinematically coupled with the rotary movement of the winding spool.

Although these conventional apparatuses operate very satisfactorily, the problem frequently arises, that the end product, which is comprised of the spool and the stranded wire wound thereon does not sufficiently meet the demands of subsequent handling.

Further, there is another problem in that it is difficult to bring a specified length of stranded wire onto the spool. This is especially a disadvantage, since the stranded wire is often reworked along with other stranded wire and this subsequent treatment must be interrupted when the spool, which has the shortest stranded wire is fully unwound. The residual length of stranded wire on the other spool must then be wound off and disposed of as waste material.

SUMMARY OF THE INVENTION

Thus, it is the purpose of the present invention to create an apparatus for and to provide a process for the making of stranded wire which improves the possibility of subsequent operations thereon.

This purpose will be achieved in accord with the invention by means of the substance of the claims.

Preferred extensions and improvements of the invention are subjects of the subordinate claims.

The invention proposes to provide the transfer apparatus with a separate drive mechanism, which will supplant the customary kinematic coupling between the rotary movement and the spool as well as the translational motion of the transfer element. Further, the invention proposes to capture the rotary motion of the spool by an RPM pickup and forward this signal to a control device. This control arrangement exhibits a program storage in which one or more programs are stored, according to which the transfer element can be controlled in accordance with the rotary motion of the spool.

The achievement of the purpose in accord with the invention offers substantial advantages as opposed to the known apparatuses of the present state of the technology. In the case of the known apparatuses, the transfer element runs in hard, kinematic coupling parallel to the axis of rotation of the spool. In this way, the wrapping pattern of the winding which is to be brought onto the spool is determined beforehand, so that only continuous layers, parallel to the cylinder axis can be wound.

By means of the configuration in the terms of the invention, it will become possible for the user to bring about optional wrapping pattern on the spool, so that the spool can be wound in such a way as to be optimal for the carrying out of further rework. Beyond this, the user of the known stranding machines is compelled to use spools in which the spool core, upon which the windings are to be laid, is cylindrically shaped.

In fact, cylindrical spools for rework operations are often disadvantageous. On this account, spools are often used as a matter of course in the present technology which have a conical wrapping core or, at least in some cases, a flange which exhibits a self extending, conical inside flange surface. Rework using such spools is not possible with conventional equipment.

In the case of the equipment in accord with the invention, the user can optionally choose the shape of the spool, insofar as it conforms to the general dimensioning of the machine. The program, with which the transfer equipment is controlled, can be adapted in a very simple manner to the given spool shape, so that the manufacturer can cover all options in regard to the spool shape.

The transfer element, moreover, can be so controlled that on the different spools a different winding pattern can be achieved to meet current requirements of the user. Thereby, the individual wishes of the user can be given more attention . In addition, the use of individual winding patterns permits the complete filling of spools, which no cylindrical wrapping core, that is to say, conical flange can show.

The achievement of the purpose in accord with the invention has yet advantages in regard to the exactness with which a defined length of the stranded wire can be brought upon the spool. In the case of conventional equipment, it is necessary, that the spool , after reaching a specific length, is still further rotated until the transfer mechanism reaches a definite position which is appropriate for change of spools.

From this, additional lengths are wound on the spool which, in many cases, must be removed from further rework to be disposed of as scrap. With the solution as proposed by the invention, it is possible to so adjust the control of the transfer mechanism, that upon reaching a specified stranded wire length, it moves itself to a position advantageous for spool change, without the spool itself rotating any further.

The apparatus in accord with the invention exhibits a sensor element, in order to capture the RPM of the spool. The signal delivered from this sensor serves as input for the control.

Advantageously, the momentary position of the transfer element is likewise determined and is input to the control unit as an additional value. Through this, the control receives the character of a closed loop control circuit. If the movement of the transfer element is effected by means of a threaded spindle, as is known in the present state of the technology, then also the momentary position of the transfer element can be determined by an RPM sensor, which counts the angle of rotation of the threaded spindle from a given null position. In this case a conventional motor can be used for the drive of the transfer element. The motor's speed of rotation will be controlled in dependency of the input values by the said program.

In a preferred embodiment of the invention, the motion of the transfer element is controlled by means of a stepping motor. In this case, advantageously, a threaded spindle is used, by means of which the transfer element is driven. The history of steps taken by the motor at any given time are stored in the control equipment, so that the control can compute at that point in the actual position of the transfer element.

Digressing from the above method, it is also possible to employ sensors which determine instantly the travel of the transfer element along a guide bar or the like.

In the case of a further embodiment to be preferred, the transfer element is activated by a linear stepping motor, whereby the actual position of the transfer element again becomes known from the number of the steps which have been taken.

Besides the above named sensors, that is, rotating or lineal stepping motors, sensors can be arranged advantageously which send a signal when the transfer element touches the first or second spool flange. Advantageously, one of these end points is a reference point, so that upon contact with this sensor, simultaneously also the null point for the stepping motor is defined.

The control equipment, in a first embodiment, is installed outside the actual stranding machine, that is, in a customary switching cabinet. In this embodiment, however, means must be provided to pick up the signals from the rotating components of the machine. For instance, this can be done with commercially available slip ring transmission or a mercury switch.

In accord with an especially preferred arrangement, the control equipment is provided directly on the spool carrier. Since the spool carrier itself undergoes no rotary motion, all sensors can be hardwired to the control facility.

The source of current in this case must be brought in over slip rings for the control equipment and drive mechanisms of the stranding machine, etc. Although relatively high demands are to be placed on the quality of the signal transmission in the case of data transmission, small disturbances in the transmission of the supply voltage will have no influence on the function.

The problems of the transmission of the control and measurement signals can also be solved, in that the transmission is done without wired connection from a sensor/receiver unit outside the machine to a sender/receiver unit inside the machine. In this case, the measurements are preferably transmitted in digital form, whereby a known modulation procedure is used, as is known in the present state of the technology, for instance, amplitude modulation or frequency modulation. In order to make the transmission of the measured values reliable and secure, the send/receive units are to be so made, that before and after each transmission of measurement and control values, a monitoring code will be included. Signals will then only be evaluated by the receiving equipment functional at the time, if the control code is identical to a given control code. The transmission of the signal can also be accomplished without hardwiring by using ultra sound, infra red, or electromagnetic waves (radio waves).

As has been explained above, the equipment in accord with the invention allows the spool to be changed without interfering with the transfer element, as soon as a predetermined length of stranded wire has been wound on the spool. In order to increase the exactness of the length of the already wound stranded wire, the invention proposes in addition, that the transfer element have a transfer pulley, or a component with several pulleys, and that the length of the stranded wire is derived directly from the angle of rotation, i.e. the number of revolutions of these rolls. In this case an additional sensor is provided for the control equipment, which counts the-revolutions of at least one of the pulleys of the transfer element and sends a corresponding signal to the control equipment.

In the present state of the technology, for the transmission of the stranded wire lengths, sets of rolls were employed, which were set before the entry of the corresponding bundle of wires into the stranding machine. However, since the length of the finished stranded wire varies a few per cent, for instance, 2 to 3%, from the length of the incoming bundle of wires, there is thus no precise determination of the length of the finished stranded wire possible. Due to the fact that the angle of rotation of a pulley of the transfer element can be captured, so the length of the stranded wire be very accurately determined, and thus the making of scrap diminished.

BRIEF DESCRIPTION OF THE DRAWINGS

One embodiment of the invention is now described in the following with reference to the drawings. Therein is shown.

DETAILED DESCRIPTION AND PREFERRED EMBODIMENT

Figure 1:
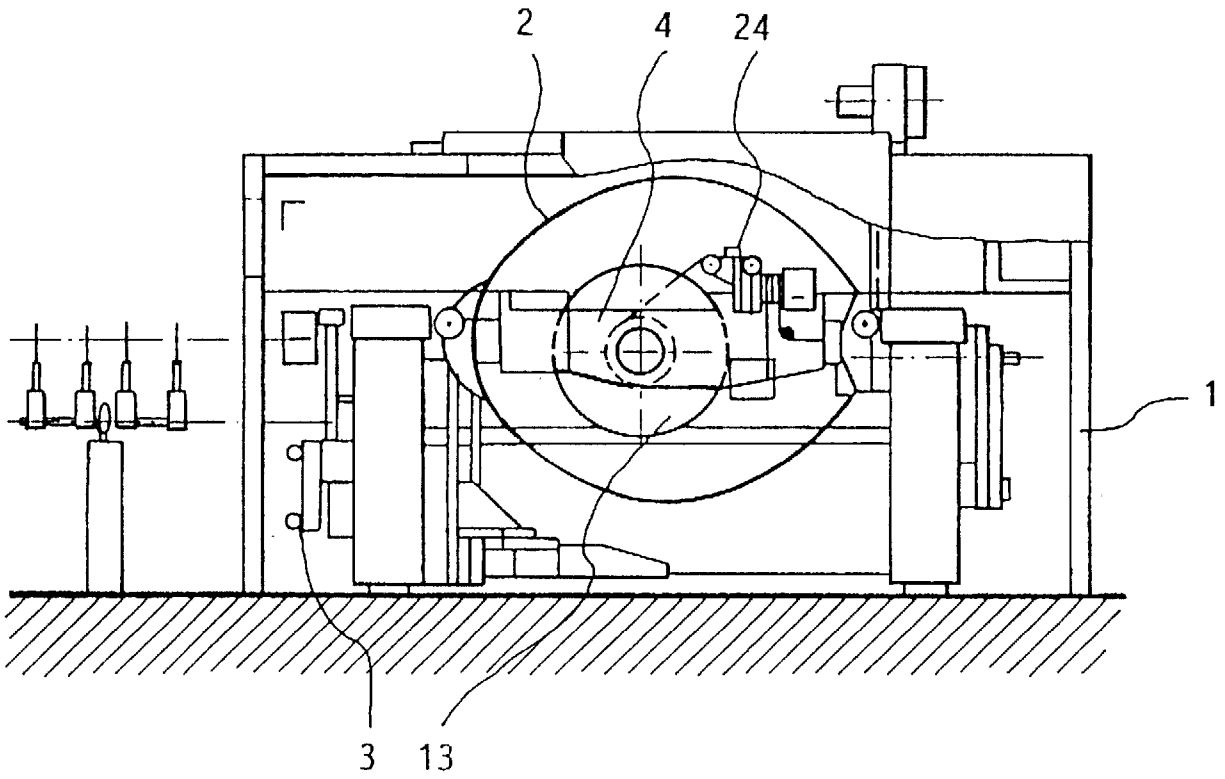
FIG. 1 a side view of one embodiment example of the apparatus in accord with the invention.

The invention will now be described in detail with the use of an embodiment example. In this embodiment the apparatus, in accord with the invention, is presented as a double stroke stranding machine. Since the principal design and the function of a double stroke stranding machine is known in the state of the technology, cognizance will only be taken of such parts as are of consequence in regard to the invention. For the construction and the function of a double stroke stranding machine,among others, the following references are given, first, to the mentioned DE 35 00 949 C2 and second to the EP 0 563 905 A1, declarations of both, by means of this reference, are herewith made a part of this declaration of the present invention.

The rotor 2, which, in this embodiment, possesses two yokes (no designation number) is swivelably mounted in the machine framing 1 of the depicted double stroke, stranding machine. The rotor 2 is driven by a motor 3. The drive of the motor is transmitted by means of a (not shown in FIG. 1) flat belt drive.

In rotor 2, a spool carrier 4 is secured in a rotatable manner. The spool carrier exhibits two carrier side pieces, 6 and 7, in which the winding spool 10 is set in bearings for rotation.

Figure 2:
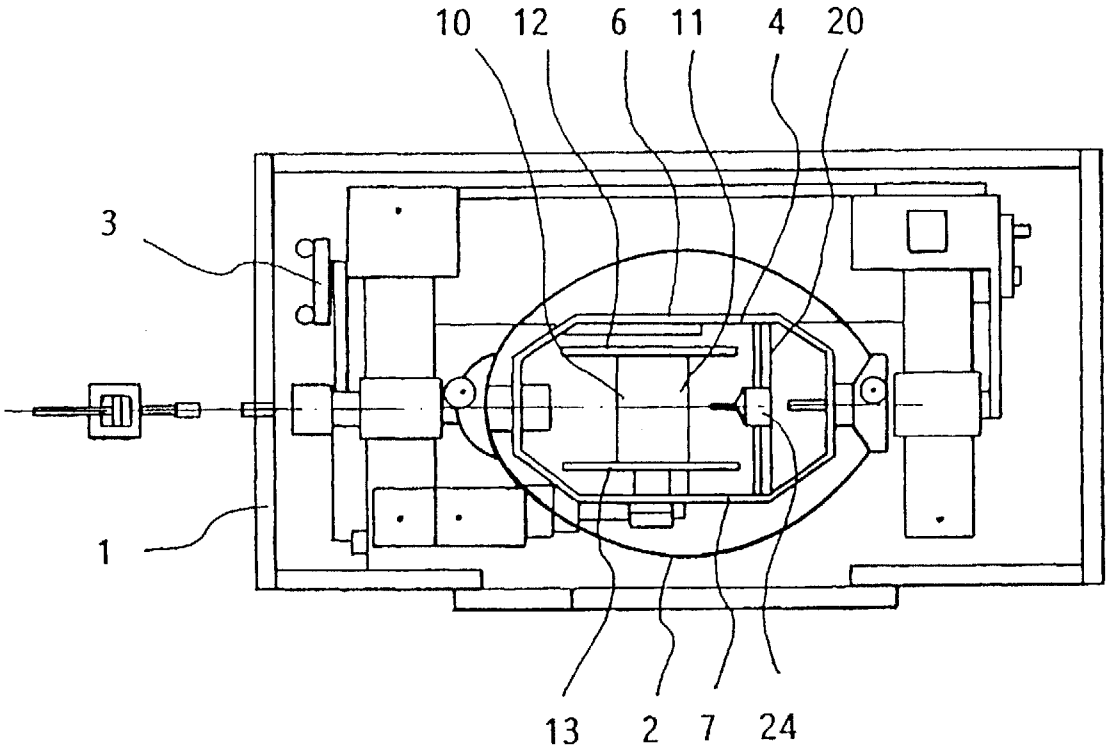
FIG. 2 a plan view of the embodiment example in accord with FIG. 1.

In the case of the presentation of FIGS. 1 and 2, is drawn a winding spool, which consists of a cylindrical winding core 11 wherein the cylinder axle is, at the same time, also the rotational axle of the spool which has two disk shaped flanges 12, 13 placed on the ends of the cylindrical core. The meaning of "disk shaped" is, that the flanges 12, 13 show themselves as a flat surface disposed vertically to the rotational axis of the winding core 11. This planar surface, on both ends of the said axle, faces the winding space in which the finished stranding will be wound.

Although, in the double stroke stranding machine, in accord with the DE 35 00 949 C2, the rotational axis of the winding spool lies parallel to the rotational axis of the rotor, the rotational axis of the winding spool in the example embodiment, in accord with FIGS. 1 and 2, is arranged transverse to the rotational axis of the rotor. Construction with parallel axes, however, is likewise possible.

The winding spool is driven by a motor and rotated, in order to wind the stranded wire.

As may be inferred from FIG. 2, a transfer mechanism 20 is provided, which (see FIG. 4) has two guide bars, 21, 22 parallel to each other by means of which a transfer element 24 is run parallel to the longitudinal axis of the winding spool 10.

The transfer arrangement is made fast to the side pieces 6, 7 of the spool carrier and is thereby secured in its spatial position relative to the spool carrier and to the winding spool.

The transfer element 24 is longitudinally movable with a sliding seat 26 along the cylindrical guide bar 21.

The second guide bar 22 is made as a threaded spindle, and rotatable with ball bearings 27, 28 in the spool carrier and, by means of a spindle nut 30, connected with the transfer element 24. The spindle nut 30 operates in such a way, that the transfer element 24 slides in a longitudinal manner along the threaded spindle 22, when this threaded spindle is set in rotation.

The drive of the threaded spindle 22 is effected by a stepping motor 32. A gear 35 is placed on the output shaft 33 of said motor. The rotary motion of this gear 35 is transmitted by means of a toothed belt 36 to a gear 37, which, by means of an adjusting spring 39, is affixed in a mutually rotating manner to the threaded spindle 22.

Figure 3:
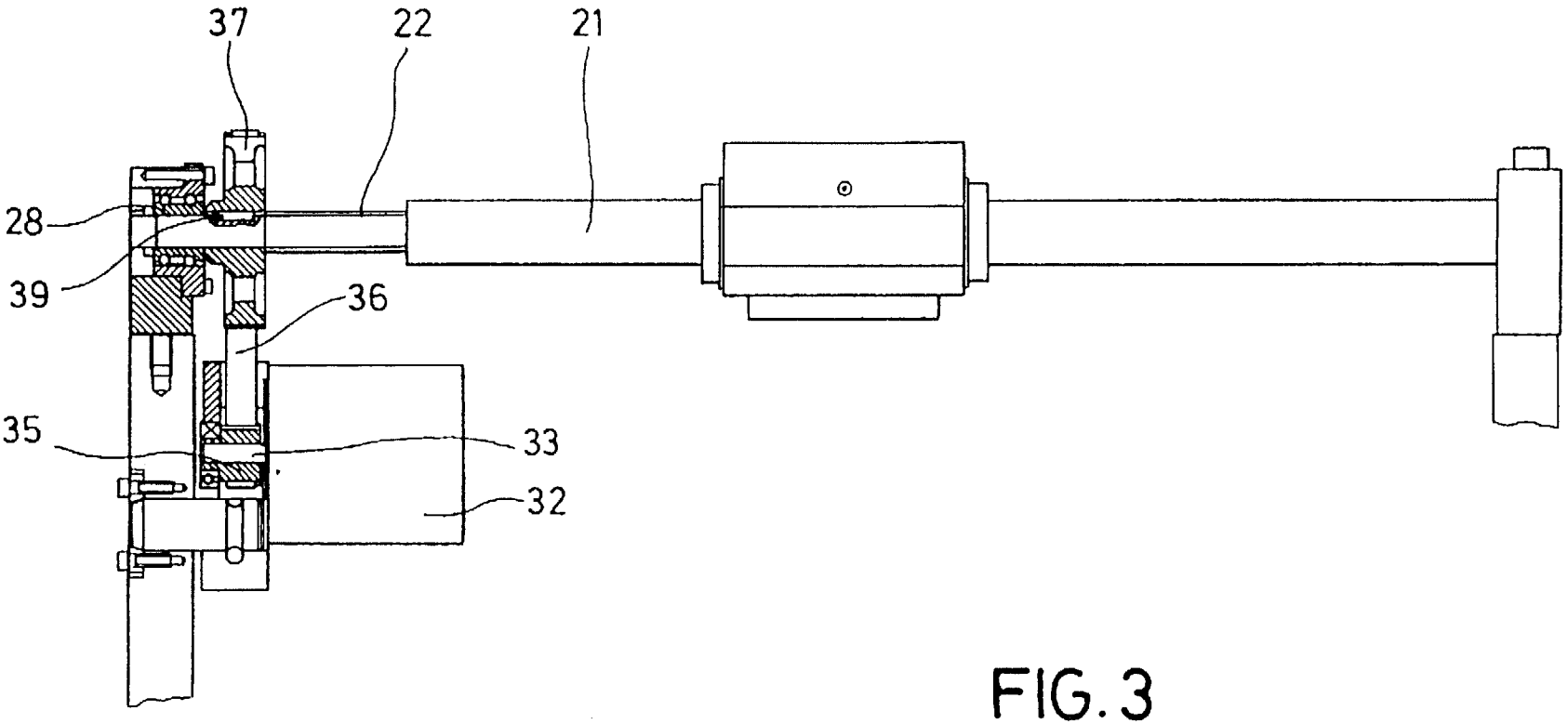
FIG. 3 a side view of the transfer equipment of the apparatus in accord with FIG. 1.
Figure 4:
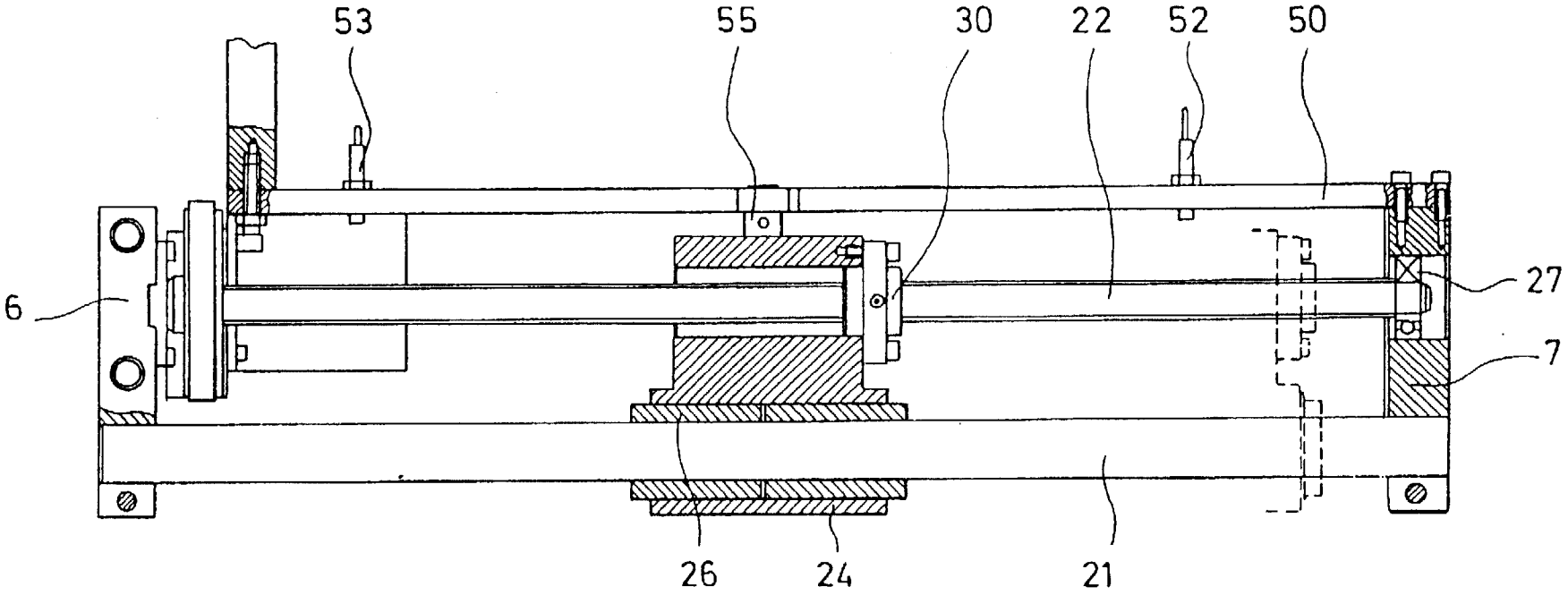
FIG. 4 a plan view of the transfer equipment of the apparatus in accord with FIG. 1.
Figure 5:
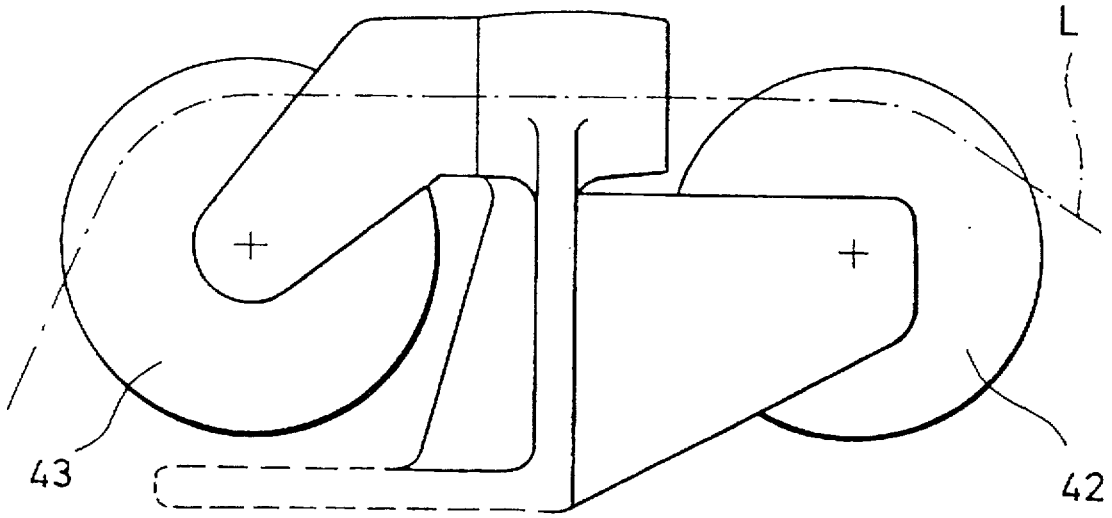
FIG. 5 a partial view of a transfer element of the embodiment in accord with the FIG. 1 to 4 with two transfer pulleys.

Affixed to the transfer element are one or more transfer pulleys, which are not presented in FIGS. 3 and 4. The stranding is run over these supplementary transfer pulleys. An example of such a transfer pulley is shown in FIG. 5, in which depicts how the stranded wire "L" runs to the winding spool over a first pulley 42 and a second pulley 43, which are always rotatably set in bearings. (Winding spool is not shown in FIG. 5, see FIG. 1).

On a bar 50, which is installed parallel to the guide rod 21 and threaded spindle 22, there is provided a first 52 and a second 53 limit switch. These limit switches emit an electrical signal, as soon as either of the protruding contact making devices 55 on the transfer element 24 comes into contact with one of the limit switches.

Figure 6:
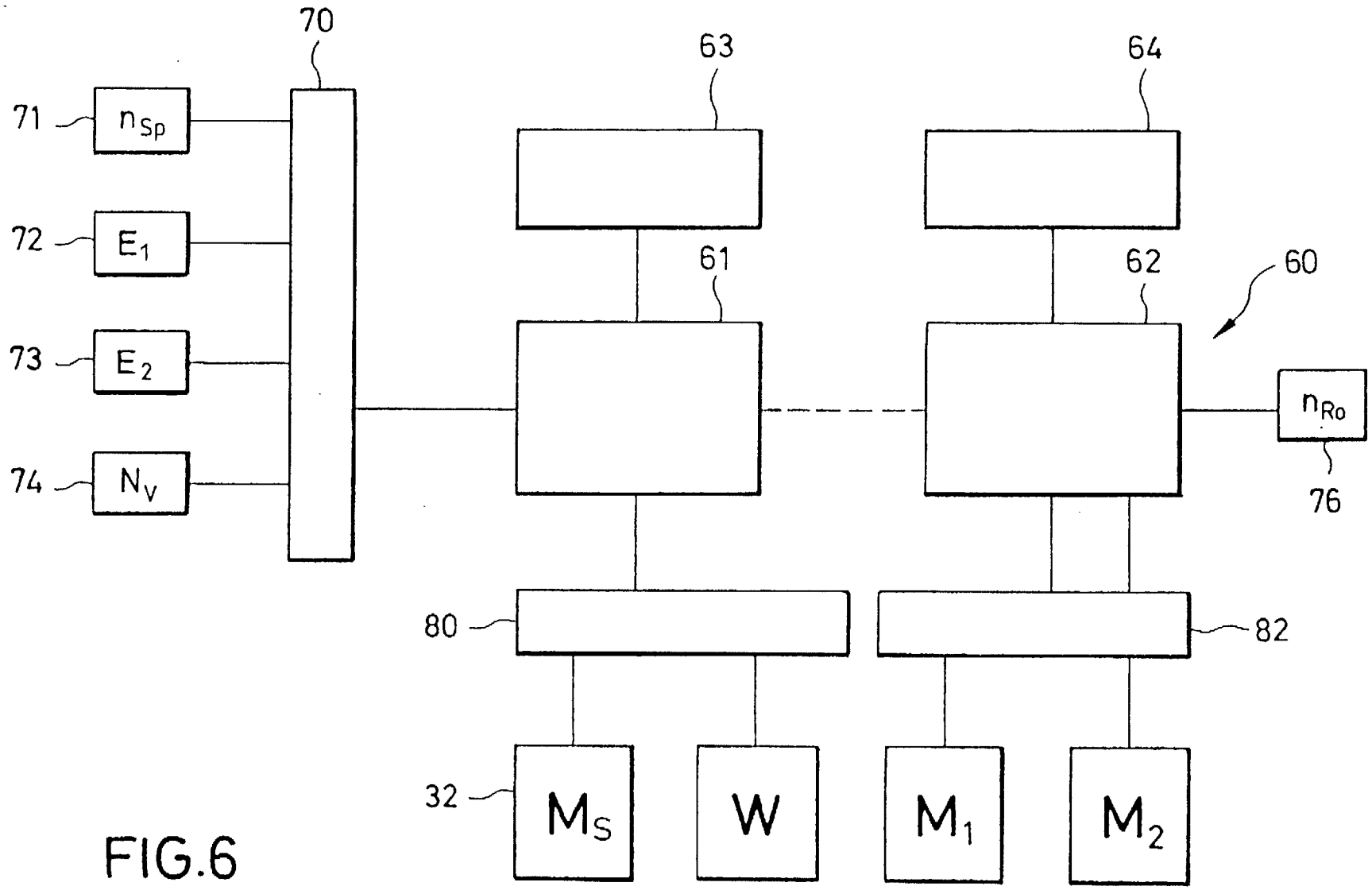
FIG. 6 the construction of control equipment for the control of the apparatus in accord with FIG. 1 to 5, and FIG. 7 and alternative configuration of a control system for the regulation of the apparatus in accord with FIG. 1 to 5.

FIG. 6 shows a first example of the control equipment, by which the double stroke stranding machine here described is regulated.

The control equipment, which is designated overall with the reference number 60, shows a first control module 61 and a second control module 62.

The first control module 61 is correlated to a first memory storage unit 63 and the second control module 62 is correlated to a second memory storage unit 64. Both storage units are provided to store programs and data.

The first control unit 61, by means of an interface 70, is connected to a series of sensors, whereby the first sensor 71 sends a signal representative of the RPM of the winding spool to the interface, while the second sensor 72 sends a signal which is emitted by the limit switch 52 of the transfer mechanism, the third sensor 73 sends a signal which comes from the limit switch 53 of the transfer mechanism and the fourth sensor 74 provides a signal, which corresponds to the count of revolutions of a pulley of the transfer mechanism.

In this control example, the first control module 61 is affixed to the spool carrier and, on this account, can be connected with the interface 70 and thereby to the individual sensors by wire connections, which are represented by solid lines.

The emitted control signals from the first control module 61 are transmitted over an interface 80 to the stepping motor 32 and a (not shown) spool clamp-in and exchange device.

The second control module 62 is mounted stationary on the machine framing 1 of the double stroke stranding machine, and receives signals from various sensors, of which, as an example, the signal from the sensor 76, which provides the RPM of the rotor, as is made plain in FIG. 6.

The control unit 62 sends out control signals over interface 82, which, for example, are conducted to the drive motor of the rotor and the drive motor of the winding spool. If the winding motor is directly correlated to the spool carrier, then its control signal is led over the interface 80 and the control module 61.

The connection between the control module 61 and the control module 62 is made by means of slip rings, as is indicated by the dotted line.

The function of this example of one arrangement in connection with FIG. 1 is as follows: At the beginning of production, or following the start of an empty spool in the spool carrier, the transfer element of the transfer mechanism is found in an end position of its back and forth linear travel. This will be indicated by the closing of the contacts of one of the limits switches, i.e. E1 or E2. The rotation counter for the transfer pulley 74 is set at zero. The motors M1 and M2 are started and the production and the winding of the stranded wire begins. The control module 61 issues the corresponding chosen program from the memory storage bank 63 to the stepping motor 32, whereby the transfer element 24 is moved parallel to the rotational axis of the spool. In this action, the RPM of the spool and the movement of the transfer element are so correlated with each other, that a prespecified winding pattern arises, which is chosen in agreement with the requirements of the rework procedure and especially in accord with the shape of the winding spool. During the continuing operation of the winding, the control module 61 can compute, at any time the position of the transfer element, which computation is made on the basis of the exchange of signals as above indicated. In order to establish a definite winding pattern, during the transfer procedure, the end points at which the transfer element reverses its travel, accordingly alters the control signals of the program. Thereby, winding layers are made , the length of which (as seen parallel to the rotational axis of the spool) is different. At the same time, or independently therefrom, the pitch of the wound layers, that is, the spacing of side by side windings to one another, can be changed.

The making of the stranded wire, and its laying on the spool will be carried on until such a time that a predetermined quantity of strand is wound on the spool. This predetermined quantity of stranding is specified by the program from the number of revolutions of the transfer pulley. As soon as the predetermined quantity of stranding is wound, the machine is stopped and the transfer element run by the stepping motor to its appropriate end position for spool exchange. The spool is then lifted out of the spool carrier by a spool changer apparatus, as is described in the EP 0 563 905 A1 and replaced by a new empty spool.

The described control equipment as depicted in FIG. 6 has the advantage, that the control unit 61 is itself affixed to the spool carrier. By this means, the signals of the single sensors, and those signals directed to the stepping motor and the equipment of the spool change apparatus can be transmitted through hardwire connections. It is basically required, that the current feed is made over slip rings.

The data exchange between the control module 61 and the control module 62 is limited to a low volume of data which is necessary for the control and the stranding machine. These data can be sent in a very simple manner over slip rings.

In another alternative to the embodiment example in accord with FIG. 6, the RPM of the rotor can also be captured with a sensor which is mounted on the spool carrier. In the case of this variant, the controller module 61 receives all the relevant data for the control of the transfer mechanism directly through sensors, which are hard wired to said control unit 61.

Through this design, a very reliable operation is achieved. moreover, the construction is also very much simplified.

Yet another construction for the control equipment is to be seen in FIG. 7 and is described in the following. This control arrangement is, in the same manner as above, adaptable to be used with the embodiment as shown in FIGS. 1 to 5. The same, or principally the same parts are defined by the same symbols and reference numbers as were used in FIG. 6.

In this embodiment example, a central control module 85 is used with a storage 86 for memory, all of which is mounted stationary on the machine frame.

The connection to the sensors 71, 72, 73 and 74 which are mounted on the spool carrier is made through interface 88, and in a first variant of this embodiment example, this is done through slip rings or mercury centrifugal switches. In a corresponding manner, the signals to the stepping motor 32 and to the spool exchange apparatus are transmitted over slip rings or similar connection means 90 for rotating members.

This embodiment example possesses the advantage that the construction of the control module 85 is in many ways, simplified. A disadvantage, however, is that a relatively higher cost is required in order to transmit data from the sensors to the interface 88.

The application of rotary connecting means of this type has the disadvantage that in the case of lower priced rotary connection means, the quality of the transmission is not always reliable, while the use of reliable sensors leads to very high expense. In a further variant, which is usable as well in connection with the embodiment example in FIG. 6 as well as with the embodiment example in accord with FIG. 7, the invention proposes on this account, to effect the transmission of the data without wiring. In this case the data, insofar as they are not already digitalized, are advantageously digitally keyed, which can be done through a change in frequency, amplitude or the phase situation of a carrier signal. Carrier signals can be, for instance, ultra sonics, infra red signals, or most especially electromagnetic (radio) waves.

Figure 7:
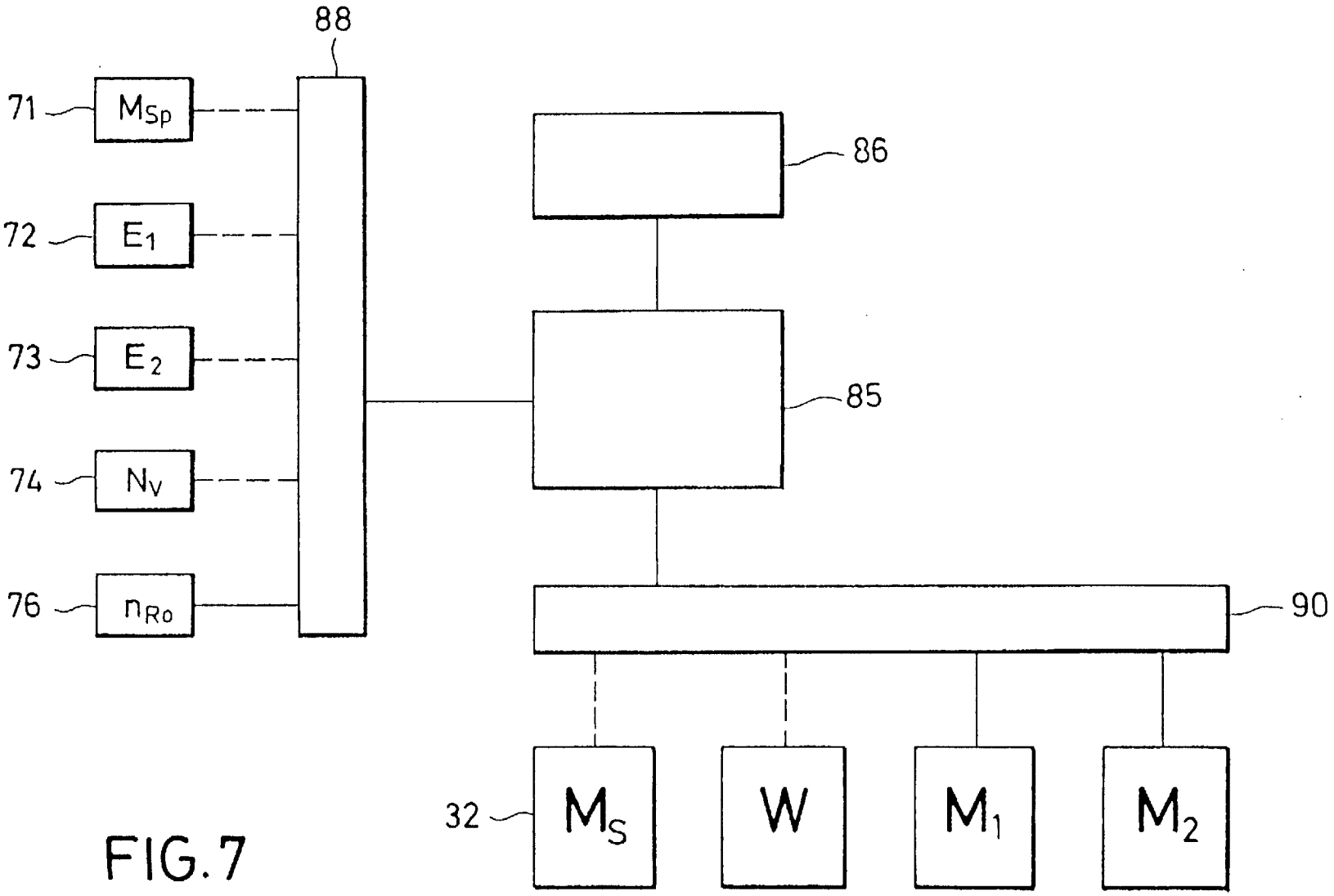

A wireless transmission can be employed in such a manner, that, in the case of the embodiment example in FIG. 7, the values of the individual sensors can be sent directly to interface 88, preferably by the insertion of yet another interface (not shown in FIG. 7). Received in interface 88, the signals are there demodulated and subsequently sent to the control module 85 as digital signals.

The transmission without wires can be particularly preferred when used in a configuration as shown in FIG. 6. In this case, the signals of the sensors 71, 72, 73 and 74 are transmitted to interface 70, sent to control module 61 and there coded into digital form. Then, the signals are sent by means of a (not shown) send/receiving apparatus to another send/receiving apparatus connected to control module 62. In the send/receiving apparatuses the signals will be modulated/demodulated.

The above described employment of a non-wired data transmission has the advantage, that the hardware equipment construction of the apparatus will be greatly simplified. Regarding a possible disadvantage of said non-wire transmission that insecurities might arise, appropriate measures can remove this difficulty. For instance, it is possible (in the embodiment according to FIG. 6) to send with every data transmission between the control module 61 and the control module 62, a n-Bit long code signal, which is switched in before and after the transmission of a data block. The current receiving control module will only process the received data when the code signal, before and after the transmission of the data block, has been received without error and is identified.

In this embodiment, indeed the apparatus and programming expenditures for the control system will be appreciably increased. However, for this increase, the practical assembly of the stranding machine will be substantially simplified, since in this case, principally a current feed for energy supply between stationary and moving parts must be made.

By means of the new configuration of the stranding machine, it is possible to use spools, which up to this time could not be installed in standing machines. For an example of such spools, reference can be made to the spools mention in the descriptions of the PCT/EP93/03404 and the PCT/EP92/02804. These applications show disassembled spools of plastic, which in a very simple and reliable manner can be reassembled into a winding spool. The use of such spools, particularly spools with conical winding cores, was not possible in stranding machines up to this time.

I claim:

1. An apparatus for the making of stranded wire out of metal wire comprising:

a machine frame (1), a rotor (2), rotatable mounted in the machine frame which rotor is rotatable driven by means of a first driving means (3), a spool carrier (4) rotatably installed in the rotor, which spool carrier is provided for the acceptance of a spool (10), which spool is rotatable driven by a second driving means (M2), a transfer mechanism (20) with a transfer element (24) mounted to the spool carrier, which moves along a guide bar arrangement (21, 22), principally parallel to the rotational axis of the said spool and by means of which the stranded wire is laid upon the spool, therein characterized, in that the transfer mechanism (20) is connected with a third driving means (32), by means of which this transfer element (24) is movable along said guide bar arrangement (21, 22), a control module arrangement (60, 85) is provided, which possesses a program storage means (63, 64, 86) which controls the movement of the transfer element (24) along the guide assembly in dependency with revolutions of the spool, and a first sensor which measures the revolutions of the spool, said first sensor being connected to the control module arrangement.

2. An apparatus in accord with claim 1, therein characterized, in that, a second sensor is connected to the control module arrangement, which second sensor determines the position of the transfer element relative to the guide arrangement (21, 22).

3. An apparatus in accord with claim 1, therein characterized, in that the third driving means is designed as a stepping motor (32).

4. An apparatus in accord with claim 3, therein characterized, in that the transfer mechanism possesses a rotatable threaded spindle (22), and in that a spindle nut (30) is provided on the transfer element (24) which embraces the threaded spindle (22) in threaded contact, and in that the movement of the transfer element in relation to the guide bar arrangement (21, 22) is activated by a rotation of the spindle 22.

5. An apparatus in accord with claim 4, therein characterized, in that the stepping motor (32) exhibits a rotating output shaft (33) and in that the transmission of the rotary motion from the stepping motor (32) to the threaded spindle (22) is effected by a toothed belt drive (35, 36, 37).

6. An apparatus in accord with claim 1, therein characterized, in that at least one position sensor is connected to the control module arrangement, which at least one position sensor defines a predetermined position of the transfer element (24) and by means of which a reference position for the movement of the transfer element (24) is defined.

7. An apparatus in accord with claim 6, therein characterized, in that the signals of the sensors, which sensors are installed stationary in relation to the spool carrier, are transmitted to the control module (85) by a rotation mechanical transmitting means, and the control module (85) is stationary in relation to the machine frame (1).

8. An apparatus in accord with claim 6, therein characterized, in that the signals of the sensors, which sensors are installed stationary in relation to the spool carrier, are transmitted to the control module (85) without wires by a means selected from the modulation of electromagnetic waves, ultra sound, or infra red impulses, and the control module (85) is stationary in relation to the machine frame,(1).

9. An apparatus in accord with claim 1, therein characterized, in that the transfer element (24) has affixed thereto at least one transfer pulley (42, 43) connected with a rotary angle sensor, in order to register the number of revolutions of the transfer pulley.

10. An apparatus in accord with claim 1, therein characterized, in that the control module arrangement (60) has a first control module (61) which is affixed to the spool carrier device (4) and a second control module (62), which is affixed in a stationary manner to the machine frame (1).

11. An apparatus in accord with claim 10, therein characterized, in that the first (61) and the second (62) control modules are connected to one another by a mechanical rotary motion transmission means.

12. An apparatus in accord with claim 9, therein characterized, in that the mechanical rotary transmission means is a slip ring means.

13. An apparatus in accord with claim 12, therein characterized, in that the rotating mechanical transmission means is a slip ring transmission means.

14. An apparatus in accord with claim 10, therein characterized, in that the first control module (61) and the second control module (62) are respectively connected to one another without wire by a sending/receiving means, wherein the transmission of the signal is by a means selected 53from the modulation of electromagnetic waves,5 ultra sound, or infra red impulses.

15. An apparatus in accord with one of the claim 1, therein characterized, in that the control module (85) is stationary in reference to the machine frame (1).

16. An apparatus in accord with claim 1, therein characterized, in that the third driving means is an electrical drive unit and electrical energy for the said drive unit is transmitted over slip rings.

* * * * *